US005282377A

United States Patent [19]

Illig et al.

[11] Patent Number: 5,282,377

[45] Date of Patent: Feb. 1, 1994

[54] METHOD AND SYSTEM OF LUBRICATING WIRE BEING DRAWN THROUGH A DIE

[75] Inventors: Dietmar Illig; Oliver Eierle, both of Augsburg, Fed. Rep. of Germany

[73] Assignee: Patent-Treuhand-Gesellschaft Fuer Elektrische Gluehlampen mbH, Munich, Fed. Rep. of Germany

[21] Appl. No.: 899,448

[22] Filed: Jun. 16, 1992

[30] Foreign Application Priority Data

Jul. 4, 1991 [DE] Fed. Rep. of Germany ..... 4122224

[51] Int. Cl.[5] ..... B21B 45/02

[52] U.S. Cl. ..... 72/43; 118/325; 118/DIG. 22; 72/286

[58] Field of Search ..... 72/41, 42, 43, 44, 45, 72/286, 39; 118/325, DIG. 22

[56] References Cited

U.S. PATENT DOCUMENTS

| | | | |
|---|---|---|---|
| 2,045,726 | 6/1936 | Richards | 72/45 |
| 2,187,785 | 1/1940 | Hoyt | 72/286 |
| 2,252,365 | 8/1941 | Fisher | 72/286 |
| 3,369,522 | 2/1968 | Alix | 118/325 |
| 3,503,120 | 3/1970 | Pierce | 72/43 |
| 3,686,908 | 8/1972 | Krafft | 72/43 |
| 3,961,511 | 6/1976 | Wolfe . | |
| 3,968,772 | 7/1976 | Greiller | 118/325 |
| 4,488,710 | 12/1984 | Greenberger | 72/201 |
| 4,553,416 | 11/1985 | Sudoh et al. . | |
| 4,688,411 | 8/1987 | Hagita et al. . | |

FOREIGN PATENT DOCUMENTS

| | | | |
|---|---|---|---|
| 013012 | 7/1980 | European Pat. Off. . | |
| 0148008 | 5/1981 | Fed. Rep. of Germany | 72/43 |
| 1213385 | 9/1986 | Japan | 72/286 |
| 2058629 | 4/1981 | United Kingdom . | |

*Primary Examiner*—Daniel C. Crane
*Assistant Examiner*—Michael J. McKeon
*Attorney, Agent, or Firm*—Frishauf, Holtz, Goodman & Woodward

[57] ABSTRACT

When drawing wire, and particularly wire of highly tenacious material which is difficult to deform, such as tungsten or molybdenum, through a die (4), lubricant is applied to the surface of the wire (1) by generating a curtain or sheet of lubricant (6, 16) emitted from a slit-like nozzle (14), and passing the wire essentially transversely through said curtain or sheet of liquid lubricant. Preferably, the wire is preheated before being passed through said sheet of lubricant so that the lubricant will dry on the preheated wire from the inside out prior to the wire being heated to optimum drawing temperature in advance of being pulled through the die. Suitable preheating temperatures are from 100° C. to 500° C., and the thickness of the curtain of lubricant can be between 0.05 to about 0.3 mm, with a wire thickness in the order of about 0.1 mm, permitting drawing speeds which can vary widely and can be about double of previously obtainable drawing speeds. The lubricant can be a standard lubricant formed essentially as an aqueous suspension of colloidal graphite.

26 Claims, 5 Drawing Sheets

METHOD AND SYSTEM OF LUBRICATING WIRE BEING DRAWN THROUGH A DIE

Reference to related patents, the disclosure of which is hereby incorporated by reference:

U.S. Pat. No. 3,262,293, MacInnis

U.S. Pat. No. 4,366,695, Petro.

Reference to related publication:

German Patent Disclosure Document DE 30 48 980, Weinhold et al.

FIELD OF THE INVENTION

The present invention relates to wire drawing, and more particularly to a method and a system to lubricate wire which is difficult to draw down to very small diameters, such as tungsten wire, molybdenum wire and the like. The invention is particularly applicable to molybdenum or tungsten wires used in the lamp industry.

BACKGROUND

It is well known to draw wire to a fine diameter by sequentially passing the wire through drawing dies, so that the diameter and the cross section of the wire are reduced in steps.

The referenced U.S. Pat. No. 4,366,695 describes, for example, a wire drawing system in which a cold wire is coated with a liquid lubricant, especially a water-graphite suspension. This lubricant must dry before the wire reaches the dies. To reduce wear, the wire is then heated so that it reaches an optimum working temperature at the die. This temperature may vary between about 450° C. to 800° C., in dependence on drawing speed.

Coating can be done by passing the wire through a container filled with lubricant, as described, for example, in U.S. Pat. No. 3,262,293, MacInnis; as an alternative, lubricant can be sprayed on the wire by projecting lubricant from a nozzle, see for example, the referenced German Patent Publication DE 30 48 980, Weinhold et al.

It has been found that these processes have some disadvantages in that the quantity of lubricant applied to the wire, with a given operating or running speed of the wire, can be controlled only by controlling the viscosity of the lubricant. The quantity of lubricant per surface of the wire increases undesirably upon increase of drawing speed. It may occur that the drying time is thereby increased undesirably, so that optimum operating temperatures at the drawing die will no longer be reached. These constraints limited the maximum drawing speed to about 75 m/min., when it is desired to reach a wire diameter of 0.090 mm.

THE INVENTION

It is an object to improve wire drawing, and particularly drawing of wires which are difficult to work, such as tungsten or molybdenum wires, by applying a predetermined quantity of wire lubricant on the wire, which application is essentially independent of drawing speed. It is an additional and important object to increase the drawing speed over that heretofore considered possible, and especially to increase the drawing speed to 100 m/min. or more, when reducing the wire diameter to for example about 0.090 mm.

Briefly, a curtain or sheet of liquid lubricant is generated and the wire is passed through this curtain, in a direction at least approximately perpendicular to the major plane of this curtain or sheet of liquid lubricant. The wire can pass through the curtain of liquid lubricant without any support at a zone of interaction between the lubricant and the wire. The curtain of liquid lubricant can be generated, for example, in accordance with a feature of the invention, by providing a nozzle with an elongated slit therein and passing the liquid lubricant from the nozzle into a receptacle, while projecting the wire essentially transversely through the thus formed curtain. The lubricant can be applied directly about the wire, so that the wire passes through the free-flowing curtain of lubricant; or the lubricant can be applied to flow against a plate which is formed with an aperture through which the wire passes, the curtain of lubricant also covering the opening in the plate through which the wire passes.

The term "curtain or sheet" is understood in the sense of the dictionary definition, that is, "... a substance that is usually very thin in relation to its length and breadth." The wire, as is passes through, or essentially transversely to the thickness of the sheet, will interact with the lubricant forming the sheet or curtain. Thus, the zone of interaction between the wire and the lubricant will be limited essentially to the thickness of the curtain or sheet. This is a dimension which is small, and readily controllable, so that a determined amount of liquid can be applied on the wire, without excess.

The direction of flow of the lubricant may be in the line of gravity, so that it flows downwardly, or it can be deflected by a plate to form an elongated sheet of lubricant through which the wire passes.

The invention is generally based on the concept that an arrangement must be provided with a defined narrow operating or interaction zone in which the lubricant application parameters can be controlled. This zone is generated by forming a wall or sheet or curtain of liquid lubricant which, for simplicity, can be referred to in general as a "lubricant curtain", arranged essentially transversely to the wire, and its drawing direction. The parameters which control the application of lubricant in such an arrangement are not only the viscosity of the liquid lubricant, but also the thickness of this "curtain", as well as the speed of flow of the lubricant forming the "curtain". Thus, by suitable selection of hydrodynamic conditions of the liquid lubricant, various parameters can be obtained and controlled.

In accordance with a preferred feature of the invention, a nozzle with a narrow, slit-like opening is used from which a stream of liquid lubricant is ejected. The resulting curtain of lubricant is highly stable, especially at high flow speeds, that is, from about 1.5 m/sec. With such high flow rates, it is not necessary to provide additional supports, so that threading of the wire through an opening or the like is not needed. It has been found, surprisingly, that the thickness of the curtain decreases from the edge towards the middle. This phenomenon permits an additional control of the parameter of application of liquid lubricant on the wire without any change in the parameters of the curtain itself by merely changing the position of the wire, laterally, with respect to the lubricant curtain, that is, the lateral position of penetration of the wire through the curtain, or the angle between the curtain and the wire.

It has been found that a drawing speed through the die of about 30% higher than previously possible can be obtained with this way and system of applying lubricant. The curtain can be additionally stabilized, for example by utilizing a small plate with a bore therethrough, on which the lubricant is applied, so that the lubricant will run along the plate and forms the curtain in the region of the bore or aperture therethrough.

It has been found that supporting the stabilizing curtain by a support plate or similar element having an essentially flat surface, especially a metal plate, is suitable if air turbulence may be experienced in the region of the curtain or the application of the lubricant on the wire. Support for the curtain is also desirable if the thickness of the curtain is relatively large, for example 1 mm, which is suitable when the wire diameter is comparatively large.

It has been found in prior art arrangements that difficulties arise in lubricant application systems using nozzles because the lubricant has a tendency to plug the nozzle, particularly when the system is placed out of operation for some time. In the method in accordance with the present invention, however, the pressure in the nozzle is so high that excellent self-cleaning effects will occur so that, even a 24-hour interruption of operation of the wire drawing apparatus is readily compensated.

In accordance with a preferred embodiment of the invention, the wire is preheated before it passes through the curtain of lubricant. Thus, the heat capacity of the wire—which is dependent on the diameter of the wire—can be used to dry the coating. Preferably, the heating is carried out to such an extent that it is sufficient for entire drying of the lubricant coating. In contrast to the prior art, the lubricant dries from the inside towards the outside, so that no pasty or semi-liquid residue will be retained beneath an already dry upper layer.

The thickness of the lubricant curtain should be selected with reference to the heat capacity of the wire, and reliably maintained. It must not be too thick, but just right so that the heat capacity of the wire is sufficient to dry the applied wire drawing lubricant. Preheating could be used in prior art application of lubricant only with very heavy wires having a high heat capacity.

The previously utilized drying of a lubricant-coated wire in a furnace has a disadvantage, since the drying occurred from the outer surface towards the inside. This has the undesirable effect that an outer skin of lubricant will dry, which, upon further drying of moisture from the layer which is beneath that skin, and still wet, may cause fissures and blow holes in the dried skin. This fissured skin reduces the lubrication effect of the lubricant. Additionally, a porous or fissured skin provides only insufficient protection of the surface of the wire against oxidation within the drying furnace.

Combining the technology of passing the wire through a curtain of lubricant with preheating further improves the drawing efficiency, and the drawing speed can be increased to even over 100% of the prior art drawing speed.

Preheating is best done in a furnace or oven in which the wire is heated to a temperature of between 100° C. to 500° C. In accordance with another feature of the invention, the wire itself can be the preheater by using resistance heating, that is, by passing electrical current through the wire itself. Under some conditions it can be desirable to provide for slight oxidation of the wire before the wire runs through a group of cascaded drawing dies, in which each group has between about 5–15 drawing dies. This improves the adhesion of the lubricating graphite layer, and heals the wire.

The method of the present invention is suitable for a wide variety of wire diameters. For example, it may be used with wires of diameters of several millimeters, as well as for final drawing stages in making fine wires, in which the diameter of the wire is 0.01 mm or even less. For final stages, the thickness of the curtain may be between about 0.050 to 0.3 mm. Such thicknesses can readily obtain with self-stabilizing nozzles. In the initial stages, in which thicker lubricant curtains are desirable, the technology using a plate over which the lubricant runs is preferred.

DRAWINGS

Figure 3A:
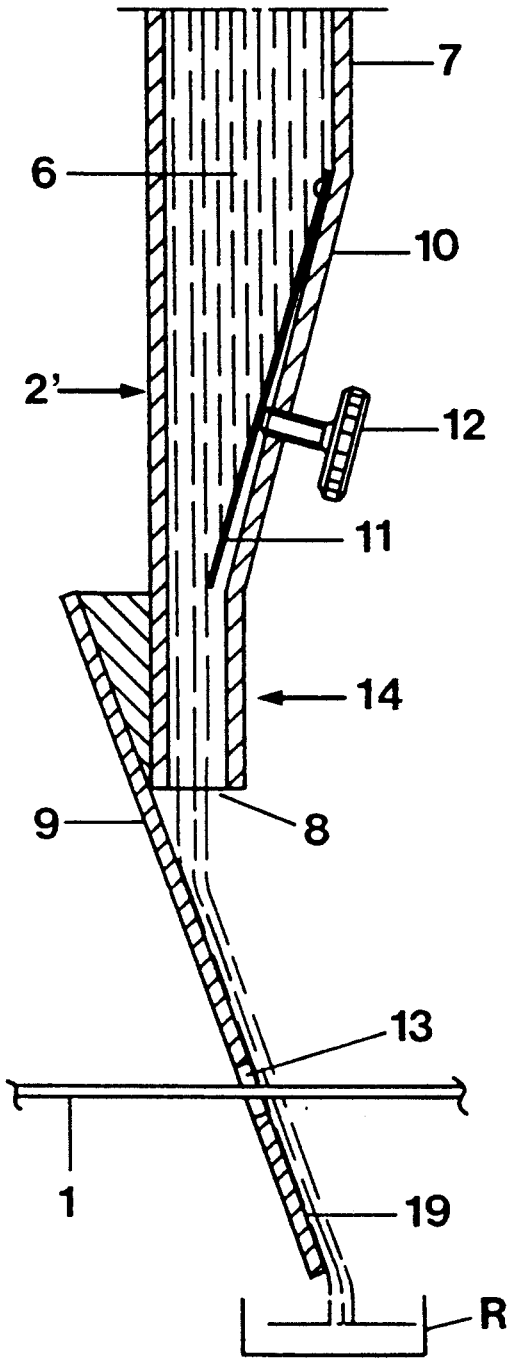
Figure 3B:
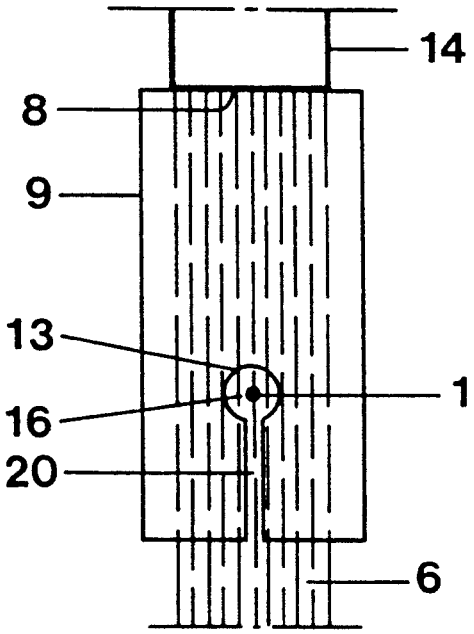
Figure 4C:
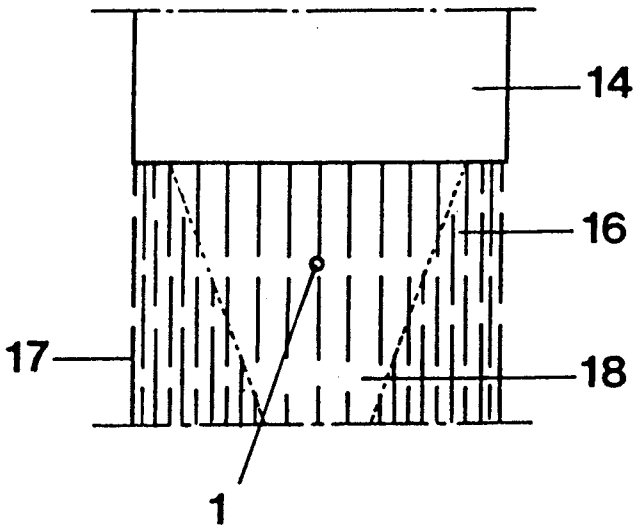
Figure 4B:
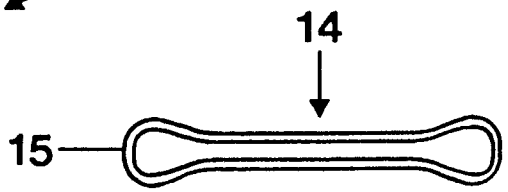
Figure 4A:
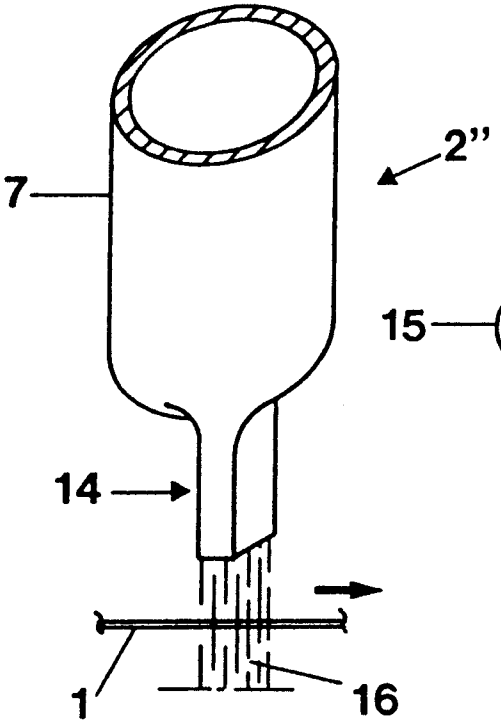
Figure 5:
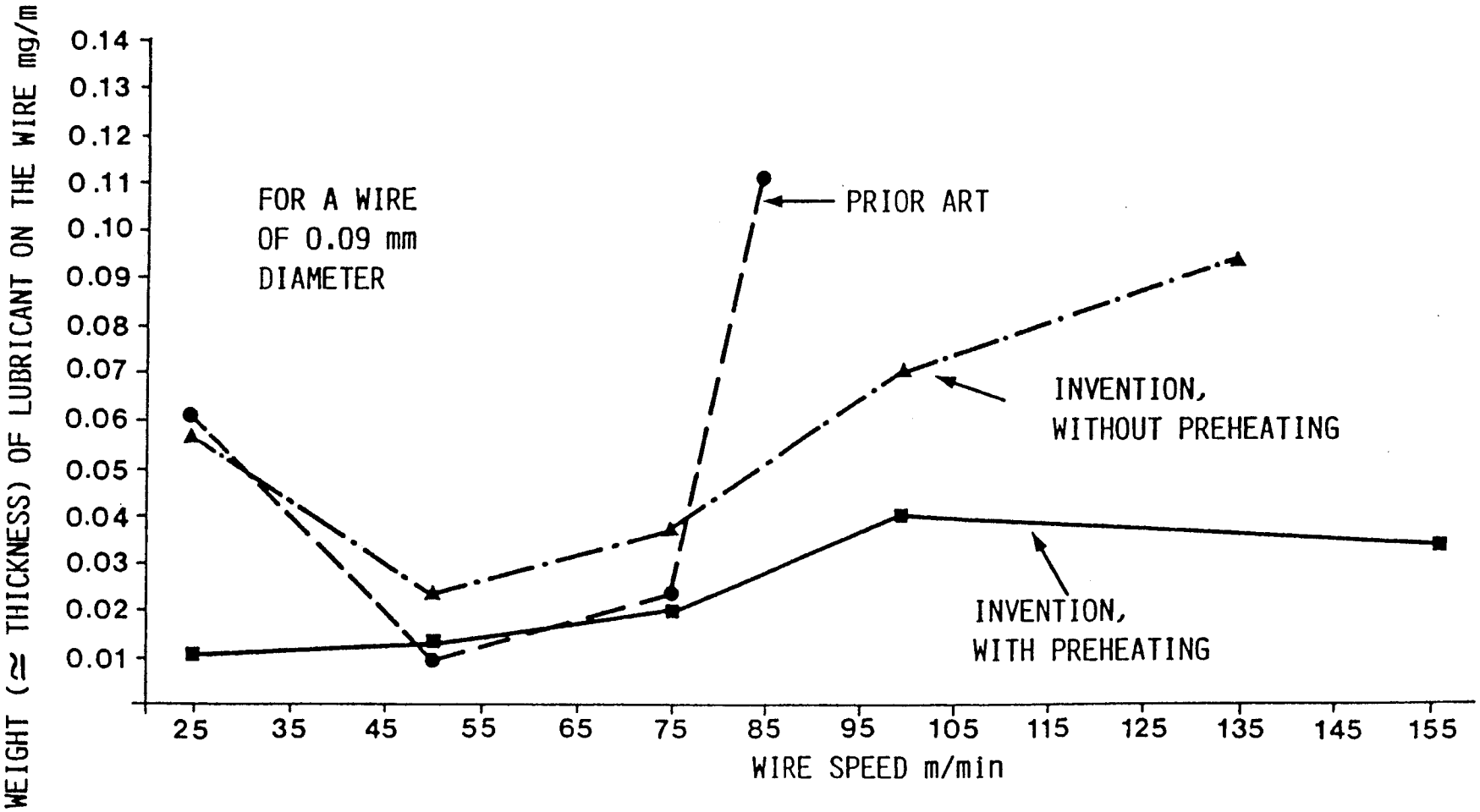

FIG. 3*a* is an enlarged fragmentary side view of a system to apply a curtain of lubricant across a wire to be drawn;

FIG. 3*b* is a front view of the system of FIG. 3*a*;

FIG. 4*a* is a perspective view of a nozzle arrangement to apply a curtain of lubricant through which a wire passes;

FIG. 4*b* is a schematic end view of the nozzle of FIG. 4*a*;

FIG. 4*c* is a schematic view of the flow distribution of lubricant issuing from the nozzle; and FIG. 5 is a diagram of quantity of lubricant (ordinate) applied to a wire versus wire speed (abscissa).

DETAILED DESCRIPTION

Figure 1:
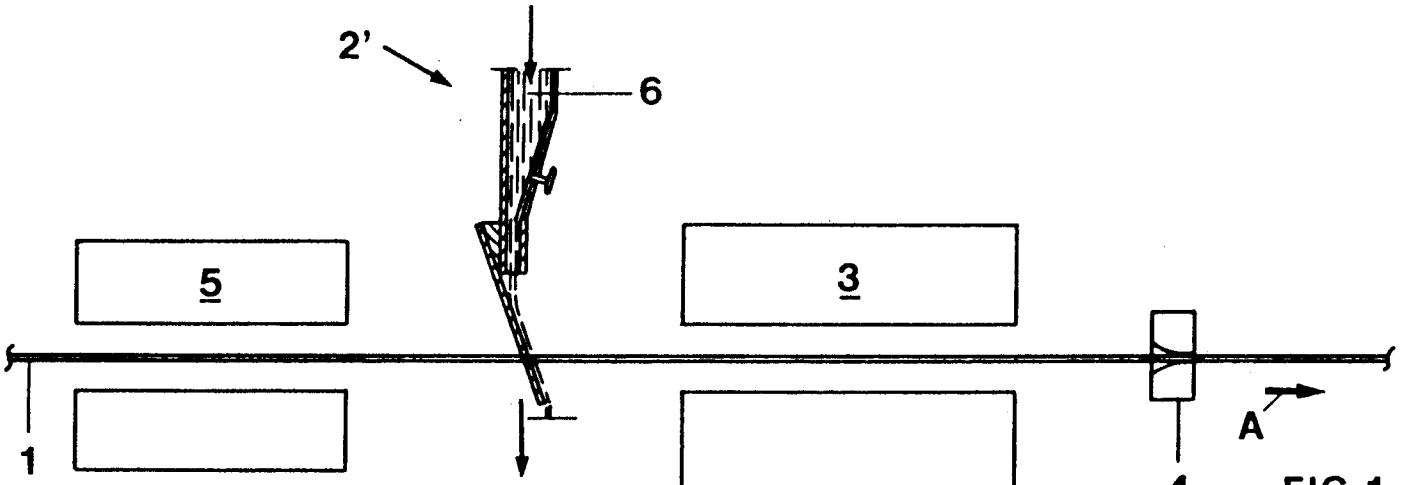
FIG. 1 is a highly schematic representation of the apparatus and system used, and illustrates the method.
Figure 2:
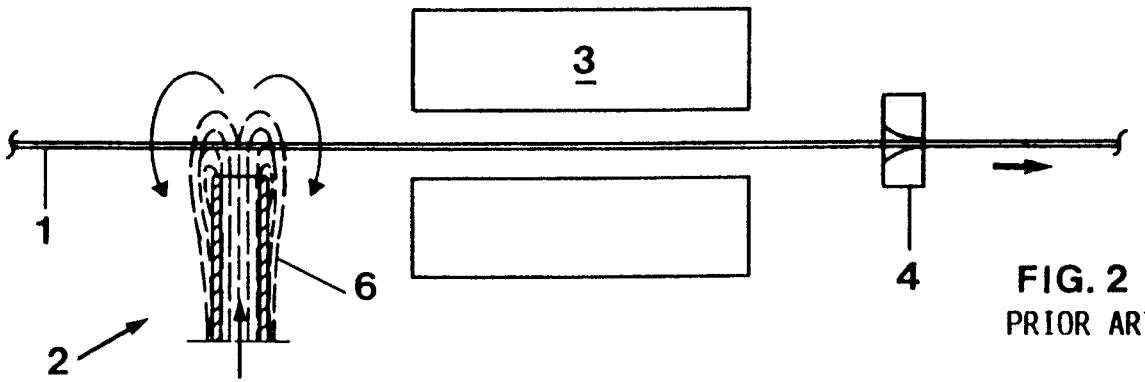
FIG. 2 PRIOR ART
FIG. 2 is a schematic illustration of a prior art method.

Considering first FIGS. 1 and 2, which graphically provide a comparison of the present invention with respect to the prior art (FIG. 2). As shown in FIG. 2, a wire 1, for example a 3 mm thick tungsten wire, is passed freely through a first station 2, in which the wire is immersed in a bath of drawing lubricant. A subsequent drying station 3 dries the lubricant. The drying station 3 can be an oven or a furnace which, besides drying the lubricant, heats the wire to such an extent that it has an operating or drawing temperature in the order of about 450° C. when it is introduced into the die 4.

The method in accordance with the present invention see FIG. 1, differs in that the moving wire 1/is, in accordance with a preferred feature, first preheated in a preheating oven or furnace 5. This heats the wire to up to about 500° C., which is a suitable maximum temperature. This high heat guarantees a substantial heat capacity of the wire. If the heating is to a higher temperature, the danger may occur that the known Leidenfrost phenomenon occurs when the lubricant is applied on the wire. The Leidenfrost point is the lowest temperature at which a hot body submerged in a pool of boiling liquid is completely blanketed by a vapor film. There is a minimum in heat flux from the body to the liquid at this temperature. The Leidenfrost phenomenon is a phenomenon in which a liquid dropped on a surface that is above the critical temperature becomes insulated from the surface by a layer of vapor, and does not wet the surface as a result. Higher heat would have the result that the lubricant vaporizes without wetting the wire 1. In dependence on wire thickness and operating speed, the preheating temperature can be as low as about 100° C., if the heat capacity of the wire is sufficient.

The lubricating station 2' is located shortly downstream of the preheating furnace 5, that is, downstream with respect to the movement of the wire 1, shown by the arrow A.

The lubricant application station 2', shown in greater detail in FIGS. 3*a* and 3*b*, applies a lubricant liquid 6 on the wire 1. The lubricant liquid 6 is a mixture of Aquadag®, which is a colloidal graphite, with water, and with small additives of ammonia and thymol. It is derived from a supply pipe 7 (FIG. 3*a*) and emitted through an elongated emission slit 8 of a nozzle 14 (FIGS. 4*a*, 4*b*) on a support element formed as a small metal plate 9. The metal plate 9 is inclined with respect to the vertical by about 20° in order to obtain a defined transition from the nozzle on the plate 9. The lubricant liquid 6 runs down along the plate 9 and is collected at the bottom at a suitable receptacle or vessel R shown only schematically in FIG. 3*a*, for example for collection or recycling. The liquid can be returned to the pipe 7 via a suitable pump. The nozzle 14 is formed with a movable deflection tongue 11 at its front side, see FIG. 3*a*. The deflection tongue is, in a rest position, essentially parallel to the front wall 10 of the nozzle 14. An adjustment screw 12 permits spreading of the tongue 11 away from the wall 10 so that the lower edge of the tongue 11 extends into the exit portion 8 of the nozzle, and reduces the width of the nozzle. This permits control of the through-put of lubricant through the nozzle element 2. The through-put can also be changed by changing the pressure of liquid being supplied by the pump—not shown—to the pipe 7, and additional change can be obtained by changing the viscosity of the lubricant, e.g. by changing the proportions of the components thereof.

The metal plate 9—see FIG. 3*b*—is formed with an opening 13 therein. This opening, for example a circular bore, has about 10 mm diameter, much larger than the wire, so that the wire passes freely through bore 13, and can be threaded therethrough. In accordance with a preferred feature of the invention, a narrow slit 20 extends from the opening 13 to the free edge of the plate 9 to facilitate threading of the wire through hole 13. The metal plate 9 is only approximately vertical—with the above referred to inclination—and thus the lubricant 6 flows across the bore 13 and forms an unsupported portion of a curtain 16 of liquid, extending approximately perpendicularly to the direction of the wire path as shown by the arrow A/and having a thickness of typically 1 mm. There is very little cross effect or turbulence caused by the wire extending across the curtain of lubricant, and very little interaction, so that an interaction zone between lubricant and wire is very small, when utilizing this curtain—flow technology. The liquid is preferably passed to cross the wire with a high transverse speed of about 1.5 m/sec. This high speed of the wire counteracts a tendency of pulling the liquid when the speed of the wire is high. Such pull of liquid along the wire would, as known from the prior art process, lead to formation of drops which, in turn, will cause periodic tear of the coating of lubricant on the wire, resulting eventually in non-uniform distribution and thickness of the lubricant film on the wire.

In contrast to the prior art process, the lubrication on the wire being passed through the curtain of lubricating liquid is very good. The variation in lubricant thickness on the wire is only a few percent. A typical thickness of lubricant is several micrometers.

Application of lubricant is so selected that the coating dries immediately based on the heat capacity of the wire. More accurately, the coating should be dry when the furnace or heating station 3 is reached. When the wire is coated in accordance with the present invention, see FIG. 1, the heating station 3 operates only as a wire heating furnace, since the lubricant is already dry when the wire reaches the station 3. This permits far more accurate control of the wire temperature at the die 4. A preferred temperature is about 450° C. The accuracy and reliability of maintenance of this temperature is improved. As a result, the wear on the die 4 is substantially less; a reduction in wear of 30% and more has been obtained.

In accordance with a feature of the invention, the drying of the lubricant coating on the wire 1 is separated from the heating process in the heating station 3. This permits more efficiency in heating, resulting in a reduction of energy use, which may reach 40°. The present invention also permits more accurate control of the lubricant so that the overall quantity of lubricant used for a given length of wire is reduced over that of the prior art.

The embodiment illustrated in FIGS. 4*a*, 4*b*, 4*c* is especially suitable for thin wires, that is, wires having a thickness in the order of about 0.09 mm. The lubricant application station 2" differs from that of the station 2' of FIGS. 3*a*, 3*b* in that the lubricant is flushed over the wire, in form of a lubricant curtain without the support plate 9. In essence, the lubricant application station 2" has the supply pipe 7 which terminates in a nozzle 14. The nozzle 14 is formed with a narrow opening having a length of about 14 mm and a width of about 0.5 mm. The narrow sides of the nozzle are slightly enlarged at their end portions 15—see FIG. 4*b*—so that lubricant is emitted under slight overpressure and forms the self-stabilized liquid curtain 16. The thickness of the curtain 16 is not uniform across its width. The edges 17, based on hydrodynamic considerations due to the expanded ends of the nozzle are thicker, for example about 0.2 to 0.3 mm, and form an essentially triangular core zone 18 (FIG. 4*c*), the thickness of which decreases towards the center to values of about 0.05 to 0.1 mm.

The wire 1 is passed through the curtain 16 in the central or core zone 18—see FIG. 4*c*—of the curtain 16 and is coated with graphite. The variable thickness of the curtain 16 permits variation of the impingement of the wire through the curtain with respect to the effective wall thickness of the curtain and thus, without changing any parameters of the curtain, to vary the effective wall thickness of impingement on the wire by shifting the impingement point of the wire through the curtain. The flow speed of lubricant in the central zone is about 4–5 m/sec., but substantially less at the edge. In general, one may consider that as the flow speed is increased, the curtain becomes thinner.

It is, of course, possible to construct the nozzle without the enlargement at the end. The curtain will still be thicker at the end regions, although somewhat less so than with the enlargements 15.

FIG. 5 illustrates the relationship of wire speed with respect to thickness of applied lubricant. The lubricant is measured in weight per unit length of wire, in the particular illustration in milligrams per meter of wire. The wire selected for the example of FIG. 5 is a tungsten wire of 0.090 mm diameter. The wire speed is shown in meters per minute at the abscissa. The prior art method is shown in the broken-line graph. The working range is narrow, between about 35 m/min. to about 75 m/min. The graph shows that lubricant is badly applied at low speeds as well as at high speeds.

The poor application occurs at low speed due to surface tension and inertia of the graphite, and at high speed because of insufficient drying.

In contrast, the process in accordance with the present invention, and utilizing a lubricant curtain, and without preheating, that is, without the preheater 5 (FIG. 1), is shown by the chain-dotted graph. The improvement is marked, particularly when the drawing speed is increased beyond 75 m/min. A speed range to 100 m/min. is readily obtainable.

Entirely new perspectives occur when the new process, in accordance with the invention, is used with the additional preheating of the wire to about 500° C. by the preheating oven or furnace 5 (FIG. 1), as shown in the solid-line curve. The wire pulling speed can be increased by about 100% over the prior art speed to about 160 m/min.—with reference to the 0.090 mm tungsten wire. The curve graphically illustrates that the preheating technology is an ideal addition to the curtain application technology, with a combined result which far exceeds what could be expected from either one of the process steps.

It has been found, surprisingly, that the thickness of the lubricant hardly changes with the speed. This is a graphic illustration that the effectiveness of the new process, in which the wire moves through a curtain of lubricant extending essentially transversely to the wire pulling direction, is highly useful. The stream of lubricant, preferably, is in an approximately vertical direction, so that its movement is supported by gravity.

The preheating oven 5 used to make the measurements to obtain the graphs of FIG. 5 had a length of somewhat under ½ meter, specifically 43 cm. Alternatively, a hot-air blower can be used which applies hot air to a heating zone of only about 20 cm length since, in this application, convection and radiation support each other. Hermetic sealing of the hot-air blower structure from the lubricant application station 2, 2', respectively, is recommended, or, at least, support of the lubricant curtain by the metal plate 9 (FIG. 3) in order to avoid disturbances by air turbulences. Alternatively, the wire itself can be used as a resistance heating element, for example by applying current to the wire by slider or roller contacts in engagement therewith, positioned along the length of the wire and in advance of the lubricant application station 2', 2''. By suitable current control in relation to ambient temperature, the desired temperatures can readily be obtained.

Various changes and modifications may be made, and any features described may be used with any of the others, within the scope of the inventive concept.

Passing the wire through the sheet or curtain of liquid lubricant essentially transversely to the direction of lubricant is the preferred form; another variation of the control of a parameter of application of lubricant can be obtained, however, by passing the wire through the sheet or curtain of lubricant at an angle; for example, and referring to FIG. 4*a*, the wire could be drawn through the sheet emanating from the nozzle 14 at an angle with respect to the vertical and/or horizontal (FIG. 4*a*), thus increasing the dwell time of the wire in the sheet or curtain of liquid.

The invention is particularly applicable to wires made of a tenacious material, that is, material which is difficult to deform and requires accurately controlled amounts of lubricant as the wire is drawn through a die, that is, especially tungsten wires, molybdenum wires and the like.

We claim:

1. A method of drawing a moving wire (1) through a die (4), particularly wire of a material which is difficult to deform, wherein, prior to passage of the wire through the die, a liquid lubricant (6) is applied to the wire (1) as it moves, the lubricant is dried, and the wire is heated to an optimal drawing temperature for subsequent drawing through the die (4), wherein, in accordance with the invention, the step of applying the liquid lubricant to the moving wire in advance of the die comprises passing the moving wire (1) through a curtain or sheet (6, 16) of lubricant liquid, wherein said curtain or sheet defines a major curtain or sheet plane, having a thickness which is substantially smaller than the lateral extent of said curtain or sheet, and wherein said step of passing the wire through said curtain or sheet comprises passing the moving wire in a direction which is at least generally transverse to the major plane of the curtain or sheet of lubricant, to form an interacting zone between the curtain or sheet of lubricant with the moving wire which is essentially limited to the thickness of said curtain or sheet of lubricant.

2. The method of claim 1, wherein the step of applying the lubricant to the wire comprises generating said curtain of liquid by ejecting the lubricant liquid (6) under pressure from a slit-shaped nozzle (14).

3. The method of claim 2, wherein the curtain of liquid lubricant comprises flowing lubricant, and wherein the flow speed of the lubricant is controlled and high enough to provide a self-stabilized curtain or sheet of liquid lubricant.

4. The method of claim 3, wherein the flow speed of the curtain or sheet of liquid in the region of the wire passing through said curtain is at least about 1.5 m/sec.

5. The method of claim 1, wherein the step of applying the lubricant to the wire comprises generating said curtain of liquid by ejecting the lubricant liquid (6) under pressure from a slit-shaped nozzle (14).

6. The method of claim 5, wherein the flow speed of the curtain of liquid in the region of the wire passing through said curtain is at least about 1.5 m/sec.

7. The method of claim 1, further comprising supporting said curtain (16) of lubricant liquid by a support plate element (9) having a plane surface (19) extending parallel to the major plane of said curtain or sheet (16) of lubricant liquid, said plate element being formed with a bore (13) extending transversely thereof through which said wire (1) is guided, the curtain of lubricant liquid washing over said bore and forming an unsupported portion of the curtain across said bore.

8. The method of claim 7, including the step of preheating the wire by subjecting the wire to ambient heat in at least one of:

an electric furnace, a hot-air blower.

9. The method of claim 1, including the step of preheating the wire to a temperature sufficient for retention of heat by the wire due to the inherent heat capacity of the wire, to dry the lubricant after the wire has passed through the curtain or sheet of lubricant.

10. The method of claim 1, including the step of preheating the wire to a temperature of between about 100°

C. to 500° C. prior to passage of the wire through said curtain of liquid lubricant.

11. The method of claim 10, wherein said step of pre-heating the wire comprises subjecting the wire to ambient heat in at least one of:

an electric furnace, a hot-air blower.

12. The method of claim 1, wherein the thickness of said curtain or sheet of lubricant is between about 0.05 mm to 0.3 mm, and the wire has a thickness of about 0.1 mm.

13. The method of claim 1, wherein said wire comprises tungsten or molybdenum.

14. The method of claim 1, wherein said liquid lubricant comprises an aqueous suspension of colloidal graphite.

15. The method of claim 1, wherein said curtain or sheet of liquid lubricant defines two edge regions;

said method further including the step of passing the wire through said curtain or sheet between the edge regions, and controlling the position of said wire with respect to said edge regions.

16. The method of claim 1, wherein said wire (1) is unsupported in said interaction zone and passed freely through said curtain or sheet (6, 16) of lubricant.

17. In a method of drawing wire, wherein the wire is moved through a die (4), the step of generating a curtain or sheet of liquid lubricant, upstream of the die (4), with respect to movement of the wire, wherein said curtain or sheet defines a major curtain or sheet plane, said curtain or sheet having a thickness which is substantially smaller than the lateral extent of said curtain or sheet of lubricant;

interacting the surface of the moving wire with the lubricant in an interaction zone defined essentially by the thickness of the curtain or sheet of lubricant, by passing the moving wire in a direction which is at least generally transverse to the major plane of the curtain of lubricant through said curtain to apply the lubricant to the surface of the wire prior to being drawn through a die.

18. The method of claim 17, including the step of preheating the wire to a temperature of between 100° C. to 500° C. prior to passing the wire through said curtain or sheet of liquid lubricant.

19. The method of claim 18, wherein said wire, after having passed through said curtain or sheet of lubricant, is subjected to further processing, including at least one of: heating; drawing through a die (4), and wherein said method further comprises the step of drying the lubricant applied to the surface of the preheated wire prior to subjecting the wire to further processing.

20. The method of claim 17, wherein said wire (1) is unsupported in said interaction zone and passed freely through said curtain or sheet (6, 16) of lubricant.

21. A system for wire drawing having a drawing die (4) through which a moving wire (1) is drawn, said system comprising in accordance with the invention means for generating a curtain or sheet of drawing liquid lubricant (6, 16), wherein said curtain or sheet defines a major curtain or sheet plane having a thickness which is substantially smaller than the lateral extent of said curtain or sheet of lubricant, said moving wire, being passed through said sheet or curtain of lubricant in a direction which is at least generally transverse to the major plane of the curtain or sheet of lubricant, whereby said moving wire, will be lubricated in an interaction zone between the curtain or sheet of lubricant and the wire, which interaction zone has a length which is essentially defined by the thickness of said curtain or sheet of lubricant.

22. The system of claim 21, including preheating means (5), located upstream, with respect to movement of the wire, of said liquid lubricant generating means (2, 2') for preheating the wire prior to being passed through said curtain or sheet of lubricant.

23. The system of claim 22, further comprising processing means including at least one of: heating means (3), said drawing die (4);

and wherein said further processing means are spaced from said lubricant curtain generating means by a distance sufficient for drying of the drawing liquid lubricant on the preheated wire after the preheated wire has passed through said curtain or sheet of drawing lubricant, and prior to passing of said wire to said further processing means.

24. The system of claim 23, wherein said preheating means (5) preheats the wire to a temperature sufficient for retention of heat due to inherent heat capacity of the wire after the wire has passed through the curtain or sheet of lubricant and prior to the wire passing to said further processing means, to dry the lubricant after the wire has passed through said curtain or sheet of lubricant.

25. The system of claim 21, wherein said sheet or curtain generating means comprises a slit-shaped nozzle (14) and a lubricant support plate (9) formed with an opening (13) through which said wire (1) is passed, said nozzle projecting a curtain or sheet of lubricant along said support plate (19) and over said opening (13), and wherein said support plate is located in an essentially vertically extending direction inclined with respect to a true vertical to permit splaying of said liquid lubricant over said plate and forming said sheet or curtain across said opening (13).

26. The system of claim 21, wherein said wire (1) is unsupported in said interaction zone and passed freely through said curtain or sheet (6, 16) of lubricant.

* * * * *